United States Patent [19]

Tropea

[11] 4,346,130

[45] Aug. 24, 1982

[54] APPLICATION OF DURABLE, ANTISTATIC, SOIL RELEASE AGENT

[75] Inventor: Alfred Tropea, Gibbstown, N.J.

[73] Assignee: E. I. Du Pont de Nemours and Company, Wilmington, Del.

[21] Appl. No.: 294,788

[22] Filed: Aug. 20, 1981

Related U.S. Application Data

[63] Continuation-in-part of Ser. No. 229,105, Jan. 28, 1981, abandoned.

[51] Int. Cl.[3] ..... B05D 3/02; B32B 27/00; D04H 1/58; C08G 12/30

[52] U.S. Cl. ..... 427/393.1; 427/393.4; 252/8.8

[58] Field of Search ..... 252/818; 427/393.1, 427/393.4

[56] References Cited

U.S. PATENT DOCUMENTS 4,279,960 7/1981 Smeltz et al. ..... 427/393.1
4,310,426 1/1982 Smeltz ..... 427/393.1

FOREIGN PATENT DOCUMENTS 1455504 11/1976 United Kingdom ..... 427/393.1
2028352 3/1980 United Kingdom .

*Primary Examiner*—Maria Parrish Tungol

[57] ABSTRACT

A process of applying a yellowing resistant, durable antistatic soil release agent:

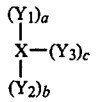

wherein

X is resin moiety having amino nitrogens and 4 to 6 methylenes, each methylene being attached to amino nitrogen and to the extent that any methylene groups are not attached they are attached to a —$OCH_3$ group.

$Y_1$, $Y_2$ or $Y_3$;

$Y_1$ is $O(C_2H_4O)_{5\text{-}20}R_1$; $R_1$ is $C_{1\text{-}5}$alkyl;

$Y_2$ is $O(C_2H_4O)_{5\text{-}88}R_2$; $R_2$ is $C_{6\text{-}20}$alkyl;

$Y_3$ is

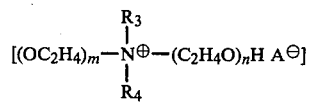

$R_3$ is $C_{4\text{-}20}$alkyl, $C_{4\text{-}20}$alkenyl or benzyl;

$R_4$ is $C_{1\text{-}4}$alkyl, $A^{\ominus}$ is anion, each of m and n is at least 1 and their sum is 12 to 100;

each of a and b is 0 to 2 and their sum is 0 to 2;

c is 1 to 2;

a plus b plus c is 1 to 4;

said agent having HLB of 14.5 to 18.0, Brookfield viscosity (20 weight % aqueous solution viscosity at 20° C.) of 0.250 to 16.000 pascal seconds, electrical resistivity (Keithley Log R) on polyester fabric (20±2% RH, 23±1° C.) less than 13.00 initially and 14.25 after 10 washes, and soil release (polyester fabric) at least 3 initially; which process comprises (a) diluting agent with water to desired viscosity, (b) adding ammonium or mono-, di- or trivalent metal salt to achieve cloud point less than 100° C. but greater than 25° C., or adding polyacidic compound having second dissociation constant greater than $1\times10^{-8}$ to pH 3.0 to 6.0, or adding both, (c) adding from 0.07 to 0.8 wt % on weight of fabric of an anionic surfactant, (d) further diluting the agent to the desired concentration, (e) applying step (c) agent to substrate, and (f) drying curing and recovering treated substrate.

19 Claims, No Drawings

APPLICATION OF DURABLE, ANTISTATIC, SOIL RELEASE AGENT

CROSS-REFERENCE TO RELATED APPLICATION

This application is a continuation-in-part of application Ser. No. 229,105 filed Jan. 28, 1981 now abandoned.

BACKGROUND OF THE INVENTION

1. Field of the Invention

The present invention relates to a process of applying a durable antistatic, soil release agent to a variety of textile fabrics.

2. Background Art

The present invention relates to an improvement over the process of applying a durable antistatic soil release agent disclosed in published U.K. patent application GB No. 2,028,352 A.

SUMMARY OF THE INVENTION

The present invention relates to the use of an anionic surfactant to improve the water absorption and the durability after washing of certain here-in-below defined antistatic soil release agents which agents are derived from melamine.

DETAILED DESCRIPTION

The present invention relates to applying to a textile a durable antistatic soil release agent of the formula

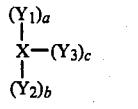

wherein

X is an aminoplast resin moiety having amino nitrogen atoms and 4 to 6 methylene groups, each of which methylene groups is attached to an amino nitrogen atom, and to the extent that any such methylene groups are not attached to $Y_1$, $Y_2$ or $Y_3$ they are attached to a $-OCH_3$ group;

$Y_1$ is $O(C_2H_4O)_{5-20}R_1$;

$R_1$ is $C_{1-5}$ alkyl;

$Y_2$ is $O(C_2H_4O)_{5-88}R_2$;

$R_2$ is $C_{6-20}$ alkyl;

$Y_3$ is

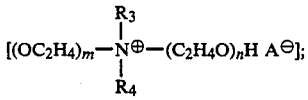

$R_3$ is $C_{4-20}$ alkyl, $C_{4-20}$ alkenyl or benzyl;

$R_4$ is $C_{1-4}$ alkyl;

$A^{\ominus}$ is an organic or inorganic anion;

each of a and b is 0 to 2 and the sum of a and b is 0 to 2;

c is 1 to 2;

the sum of a, b and c is 1 to 4;

each of m and n is at least 1 and the sum of m and n is 12 to 100;

said agent having a calculated hydrophile-lipophile balance (HLB) of 14.5 to 18.0, a 20 weight % aqueous solution viscosity, as measured at 20° C. on a Brookfield viscometer, of 250 to 16,000 cps (0.250 to 16.000 pascal seconds), an electrical resistivity (Keithley Log R) on polyester fabric, at 20±2% relative humidity (R.H.) and 23°±1° C., of no greater than 13.00 initially and no greater than 14.25 after 10 washes, and a soil release rating on polyester fabric of at least 3 initially. Preferably, in the above formula: $Y_1$ is $O(C_2H_4O)_{10-16}CH_3$; $Y_2$ is $O(C_2H_4O)_{15-30}C_{13}H_{27}$; $R_3$ is $C_{8-18}$ alkyl, or $C_{8-12}$ alkyl to achieve good water wettability (drop absorption), $R_4$ is $CH_3$, $A^{\ominus}$ is $^{\ominus}OSO_3CH_3$ and m+n is 20 to 50; the HLB is 15.5 to 17.0; and the 20% aqueous viscosity is 2,000 to 8,000 cps (2.000 to 8.000 pascal seconds). The preparation of these antistatic, soil-release agents is described in published U.K. patent application GB No. 2,028,352 A.

The process of the present invention is carried out in the presence of an anionic surfactant. The preferred anionic surfactants are the alcohol sulfates containing 12 to 22 carbon atoms, such as lauryl sulfate, the alkyl sulfonates containing 12 to 24 carbon atoms, and the alkaryl sulfonates containing 3 to 16 alkyl carbon atoms and phenylene or naphthalene as the aryl moiety. Although it will be described in greater detail hereinafter, the process of the invention resides in a process for applying the aforesaid agent to a substrate, which process comprises the steps:

(a) Diluting the agent with water to achieve the desired liquid viscosity, this generally results in a 20.5±1% solution.

(b) Adding sufficient salt of a mono-, di- or trivalent metal or of an ammonium cation to achieve a cloud point, of the diluted agent of step (a), of less than 100° C. but greater than 25° C., or adding sufficient polyacidic compound having a second dissociation constant of greater than $1\times10^{-8}$ to achieve a pH, of the diluted agent of step (a), of 3.0 to 6.0, or adding both said salt and said polyacidic compound to achieve said cloud point and pH.

(c) Adding anionic surfactants at an exhaust bath concentration of 0.0035 to 0.04% on weight of bath, which corresponds to 0.07 to 0.80% on weight of treated fabric. The preferred level for the anionic agents is 0.02% on weight of exhaust bath corresponding to 0.40% on weight of fabric. For padding baths with 40% wet pick-up the corresponding range is 0.17 to 2.0% on weight of bath with 1.0% on weight of bath being the preferred level. The anionic surfactant is selected from the class consisting of alkyl sulfates containing from 12 to 22 carbon atoms, alkyl sulfonates containing from 12 to 24 carbon atoms, and alkaryl sulfonates containing 3 to 16 alkyl carbon atoms and phenylene or naphthylene as the arylene moiety.

(d) Further diluting the agent with water to the desired application concentration.

(e) Applying the diluted agent of step (c) to the substrate to be treated so as to achieve the desired level of agent on the substrate.

(f) Drying and curing the agent on the substrate.

(g) Recovering substrate which has been durably treated with the agent of the aforesaid formula.

Finally, the invention herein also resides in substrate which has been durably treated with the aforesaid agent.

The antistatic, soil release agent used in the present invention is prepared by conventional techniques by contacting, in appropriate amounts, under appropriate reaction conditions, appropriate precursors of the aforesaid moieties X and $Y_3$ and the optional moieties $Y_1$ and $Y_2$.

Exemplary of X moiety precursors which can be used to produce the agent of the invention are the melamine methylol derivatives having 4 to 6 methylol groups, which methylol groups can be ether capped with, for example $C_{1-4}$ alkyl. The optional $Y_1$ and $Y_2$ moieties can be provided by the commonly available polyethylene oxides. For example, polyethylene glycol monoethers having 5 to 20 ethyleneoxy moieties and $C_{1-5}$ alkyl ether end groups are commercially available under the Carbowax® designation, thus providing a source of the $Y_1$ moiety. Similarly, the $Y_2$ moiety is provided by commercially available materials, such as those designated Merpol®, which are polyethylene glycol monoethers having 5 to 88 ethyleneoxy moieties and $C_{6-20}$ alkyl ether end groups.

In a particularly preferred aspect of the invention an alkali metal salt of one or more lower alkyl phosphates is added to the treating bath. Potassium mixed butyl phosphates (50% Solids) are preferred for this purpose. These phosphate salts are used at a level of 0.3 to 1.% on weight of fabric corresponding to 0.015 to 0.05% in an exhaust bath or 0.75 to 2.5% in a wet pick-up padding bath. The preferred phosphate salt level is 0.80±0.2% on weight of fabric corresponding to 0.04±0.01% in an exhaust bath or 2.5±0.5% in a 40% wet pick-up padding bath.

The antistatic, soil release agent is diluted to a manageable viscosity, so that it can be applied when diluted by conventional techniques, for example, by padding or exhaust. The antistatic, soil release agent is a solid at room temperature and must be thawed at a temperature of at least 50° C., preferably under a nitrogen atmosphere. The antistatic, soil release agent can be diluted with water (at 25° C.) until the desired (manageable) viscosity is achieved.

The process of the invention can be used to treat textile fibers which may or may not subsequently be converted to fabric and to treat substrates which are flexible or nonflexible shaped structures of polymeric materials other than textile fibers and fabrics, for example, molded articles as well as extruded products, such as film and tubing. The process of the present invention finds its greatest advantage in treating polyester (such as polyethylene terephthalate).

A weighed portion of the viscous condensate is added slowly to a rapidly stirred quantity of water (the addition of water to the condensate may yield a difficult-to-manage gel-like material). After the condensate dissolves, the mixture is made alkaline to minimize hydrolysis of the product on storage; for example, the pH is adjusted to 7.7–8.2 by addition of sodium bicarbonate. If desired, enough water can be added to bring the mass to, for example, a 20 weight % aqueous solution. Such a solution has a Brookfield viscosity of 250 to 16,000 cps (0.250 to 16.000 pascal seconds) at 20° C. In the treatment of fabrics, a more dilute aqueous solution is used, for example, less than 1 weight % in an exhaust application.

The antistatic, soil release agents used in the present invention have a calculated hydrophile-lipophile balance (HLB) of 14.5 to 18.0 and a 20 weight % aqueous solution viscosity, as measured on a Brookfield viscometer, of 250 to 16,000 cps (0.250 to 16.000 pascal seconds). In general, all other variables being maintained constant, the higher the viscosity, the better will be the durability achieved with the agent of the invention on the fabric being treated.

The Brookfield viscosity is determined by the American Society of Testing Materials Test Method D-1824, with modifications thereto being as follows:

1. Viscosities are measured at 25°±0.4° C.
2. Samples are bubble-free when viscosities are determined.
3. Viscosity is determined sequentially one to three times, on a given sample.
4. Viscosities are reported in centipoises (cps; pascal seconds).

The hydrophile-lipophile balance (HLB) system is the subject of numerous publications, for example, "Classification of Surface-Active Agent" by HLB, "W. C. Griffin, J. Soc. Cosmetic Chemists 1, 311 (1949); " "Calculation of HLB Values of Non-ionic Surfactants," ibid. 5, 249 (1954); "The Atlas HLB System," Atlas Chemical Industries, Inc., Wilmington, Del., 4th printing, May, 1971; Proceedings 2nd Int. Congr. Sur. Act. 1, 426 (1957), Academic Press, New York, N.Y. HLB values reflect the hydrophilic content of the molecule. In accordance with the information available from the aforesaid publications, calculated HLB values are determined herein by means of the equation:

$$\frac{\text{sum of the molecular weights of all the hydrophilic moieties of the molecule}}{\text{molecular weight of the entire molecule}} \times 20 = \text{Calculated HLB.}$$

The fabric used in the evaluation of the agent of the invention in Examples 13–24 is produced from Dacron® Polyester Double Knit. The fabric is white, undyed (denier/gauge) double knit fabric. The fabric is scoured at 71° C. for 20 minutes with 0.5 gram/liter (0.001 $m^3$) of Merpol® SH nonionic detergent and 1 gram/liter (0.001 $m^3$) of trisodium polyphosphate. After being rinsed well with water the fabric is dried. The fabric used in Examples 1–12 is a cotton.

The active ingredient in the bath being tested is exhausted onto the fabric from the exhaust bath containing the agent, the appropriate salt, in an appropriate amount, while the bath is heated to within about 5° to 10° C., for example, about 6° C., of the cloud point and held there until exhaust is complete. This is usually effected in no more than 5 to 10 minutes, for example, 6 minutes. The treated fabric is then removed from the exhaust bath, rinsed, if desired, cooled, extracted of water (using conventional extraction techniques to remove excess water) and cured.

The cured fabric is rinsed in softened water to remove residual salts or acids and then dried, for example, in a commercially available Sears Roebuck dryer (Kenmore Model 600), at 71°±5° C. The process of the invention is tested for its antistatic characteristic on the fabric using the American Association of Textile Chemists and Colorists (AATCC) Test Method 76-1975 with slight modification as described below. Testing of fabric samples is carried out in a dry box at 20±2% relative humidity and 23°±1° C., the humidity being controlled by a commercially available Hydrometer Indicator Controller (Model 15-3252) with a Model 15-1810 sensing element. Testing equipment includes a Keithley Model 610C Electrometer in combination with a Keithley Model 240A High Voltage Supply and a Model 610S Resistivity Adapter. Further description of this test may be found in the AATCC Technical Manual under the aforesaid test method which is entitled "Electrical Resistivity of Fabrics." Testing of fabric samples is carried out initially (after rinsing) and then after five and ten home laundering/tumble dry cycles, commonly referred to as home wash/tumble dry (HWTD) cycles. The antistatic (A.S.) data appear in the accompanying tables under the heading "A.S.," with the symbols "I, 5W, 10W" being used to indicate the antistatic characteristic initially and after five and ten washes (HWTD) cycles), respectively. As indicated above, the agent of the invention must exhibit an electrical resistivity (Keithley Log R), a measure of the antistatic characteristic of the agent, on polyester fabric, at 20±2% relative humidity and 23°±1° C., of no greater than 13.00 initially and no greater than 14.25 after ten washes. For comparison, it may be noted that clean, untreated cotton broadcloth at about 20% relative humidity and about 23° C. exhibits a Keithley Log R of 13.65±0.05. Untreated polyester fabrics, in general, exhibit Keithley Log R values of 15.5 to 16.0.

The home launderings are carried out, in general, according to AATCC Test Method 124. Equipment used includes a Sears Roebuck Kenmore automatic washer (Model 600) and a Sears Roebuck Kenmore automatic dryer (Model 600). This is the same dryer described above for drying the fabric samples which have been rinsed in soft water. Test fabric specimens are cut to 20.3 cm squares and introduced into the washer along with "load fabric" (hemmed pieces of cotton sheeting; 97.4 cm squares) to give a total dry load of 1.8±1 kilograms. To the washer are added 28 grams of commerically available Tide® detergent. Washing is carried out under a normal wash cycle (12 minutes), at the high water level setting, using a hot water temperature of 60°±3° C. Soft water (hardness of no more than 5 ppm) is used. Following washing and spin-drying the fabrics are dried in the dryer at a normal cycle time of 45 minutes, with the temperature dial being set on high to give a maximum stack temperature of 71°±5° C. This cycle is repeated to achieve the desired number of home launderings.

The soil release (S.R.) characteristic of the process of this invention is determined by AATCC Test Method 130 except spent crankcase oil/Nujol® mixture was used as the soiling agent. The treated and cured fabric samples used in the soil release test are prepared in the same manner as those used in the antistatic performance test described above. The soil release test measures the ability of a fabric to release oily stains during home laundering and, as indicated above, the antistatic soil release agents used in this invention must exhibit a soil release rating on polyester fabric of at least 3 (initial), that is, before being subjected to the home laundering test. Data relative to this soil release test are provided in Table II; with data being included to show the soil release ratings initially (I) and after a plurity of five (5W) HWTD cycles. Test specimens measuring 10 cm×20 cm are conditioned for four hours at 21°±1° C. and 65±2% relative humidity prior to staining. A single flat thickness of test specimen is placed on AATCC Textile Blotting Paper on a smooth horizontal surface and five drops (each having a volume of about 0.2 ml; $0.2\times10^{-6}$ m$^3$) of a commercially available oil test liquid (60 weight % Nujol® and 40 weight % used piston engine automotive oil) are applied to the test specimen. The oil puddle (total volume, about 1 ml; $1\times10^{-6}$ m$^3$) which is formed is covered by a 7.6 cm×7.6 cm piece of glassine paper and a 2.28 kilogram weight is placed on the paper. After 60 seconds the weight is removed and the glassine sheet is discarded. The oil-stained fabric specimen is then subjected to washing. Washing is carried out within 15 to 60 minutes of staining with such a number of test specimens that the total number of oil stains in the wash does not exceed thirty. Setting a maximum limit on the number of oil stains provides latitude in selecting the number of test specimens used in the event that it is desirable to place more than one oil stain on each test specimen. The aforesaid Kenmore Model 600 automatic washer is filled to the high water level with water at a temperature of 60°±3° C. To the washer are added 140±5 grams of AATCC Standard Detergent 124, or a known equivalent. Then the test specimens and cotton sheeting ballast, so as to make a total load of 1.8±0.1 kilograms, are introduced. The washer is run through a normal wash cycle (12 minutes). Following completion of the spin-dry cycle, the specimens and ballast are placed in the aforesaid Kenmore Model 600 dryer. Drying is carried out at the high setting (71°±5° C.), maximum stack temperature, for 45±5 minutes. The dried test specimens are rated for residual stains within four hours after drying. Evaluation is made by comparing the residual stains in the test specimen with a standard soil release rating chart. Stains are rated on a scale ranging from 1 to 5. The higher the number, the less is the residual stain.

As stated above, water wettability of the agent of this invention is determined by the drop absorption test which is based in general on AATCC Test Method 39. The test employs the same type of treated/cured fabric specimens described above. Fabric specimens are conditioned at 65±2% relative humidity and 21°±1° C. for at least four hours before testing. Each fabric test specimen is placed on blotter paper on a table top. Water is dropped onto the surface of the fabric in a dropwise fashion from a conventional eye dropper (each drop having a volume of about 0.2 ml; $0.2\times10^{-6}$ m$^3$) held about 1 cm above the surface of the fabric. The time is measured, using a stop watch, from the moment that the first drop falls from the dropper until the wet area of the fabric loses its specular reflective power. This can best be observed by placing the fabric between the observer and a source of light at such an angle that the specular reflection of light from the surface of the flattened drop (as the drop hits the surface) can be plainly seen. As the drop is absorbed by the fabric, specular reflection of light ceases and a dull wet spot is formed on the fabric. High drop absorption times, for example, above 5 seconds, indicate poor wettability of the treated fabric.

Additional information on all of the aforesaid test procedures may be found in the AATCC Technical Manual.

Optimum benefits from the agent of the invention are achieved using specialized techniques of application that are tailored to the type and characteristics of the fabric being treated. The agent of this invention can be applied by pad or exhaust procedures. In either procedure, the diluted aqueous condensate described hereinabove, is applied to the fabric which is to be treated. The addition of an organic polyacidic compound and/or an inorganic acid which is at least divalent provides antistatic durability of the agent of the invention, when padded onto the fabric, through at least ten washes. The addition of a salt of a mono-, di- or trivalent metal or of an ammonium cation provides both soil release and antistatic durability of the agent, when either padded or exhausted onto the fabric, through at least ten washes. Preferably, to achieve maximum effects for pad application, both the acid and the salt are present along with the agent of the invention. It has been found that, in exhaust application, the salt must be used alone. In other words, exhaust application cannot be carried out with acid alone or with the combination of acid and salt.

The second dissociation constant of the inorganic acid which is at least divalent and that of the organic polyacidic compound must be greater than $1\times10^{-8}$. Examples of such materials include citric, oxalic, tartaric, succinic, glutaric and phosphoric acids. Boric acid, on the other hand, is unsatisfactory because the second dissociation constant is below the aforesaid minimum value. It has been found that low molecular weight polyacrylic acids also are useful herein. Although such materials are polyacidic, various dissociation constants of the carboxy groups are not readily determinable because of the polymeric nature of the material. The operability of such an acid herein suggests that it meets the aforesaid requirement on second dissociation constant. Useful polyacrylic acids include those which are readily soluble in water. Such materials include those having molecular weights up to at least 5,000. In using the polyacidic compound, alone or in combination with the salt, the pH of the treating bath should be in the range 3.0 to 6.0, preferably 4.0 to 5.5.

The function of the salt of a mono-, di- or trivalent metal or an ammonium salt, including an appropriate quaternary ammonium salt, appears to be related to its ability to lower the cloud point of the dilute aqueous solution of the agent of the invention below 100° C. The salt should have sufficient ionic strength to lower the cloud point below 100° C. but it should not be such as to insolubilize the product at ambient temperature (25° C.). Lowering of cloud point is determined using a 0.2 weight % aqueous solution of the agent. Examples of salts which may be employed herein alone or in combination with the organic polyacid include, but are not limited to, calcium, magnesium, zinc and sodium nitrates; the sodium phosphates, such as disodium hydrogen phosphate and trisodium phosphate; sodium, magnesium and calcium chlorides; sodium, magnesium, zinc and aluminum sulfates, sodium and ammonium oxalates; calcium acetate and diammonium citrate. Salt hydrates are equally useful. The use of the salt assists in the deposition of the agent of the invention during exhaust application by lowering the upper cloud point and thus, the agent is retained throughout the fabric, (i.e.,) substantial amounts do not migrate, and it enhances the crosslinking which takes place during the drying/curing step as water is evaporated from the treated fabric. In general, it may be said that the cloud point is raised as the HLB is increased.

Curing conditions will vary depending on the moisture content of the fabric, the higher the moisture content, the longer the time and/or the higher the temperature required. In general, for exhaust and pad applications, curing is carried out at 149° to 204° C. A preferred temperature range is 193° to 199° C. Curing at the preferred temperature conveniently can be carried out in less than one minute, for example, in 15 to 30 seconds, depending on moisture content and the weight of the fabric, when the agent of the invention is applied by exhaust techniques. For padding operations wherein moisture levels are higher, longer times usually are required, for example, 60 to 75 seconds. Durability of the agent of the invention on the fabric requires careful control of curing conditions. Under-curing as well as over-curing will result in diminished durability of the agent. It is to be understood that curing conditions must be determined, for the most part, empirically. For example, a hydrophilic fabric (that is, one retaining moisture readily) will require more rigorous curing conditions than a hydrophobic fabric. Similarly, selection of salt and/or acid, and the amount thereof, are usually determined empirically.

The amount of agent of the invention applied to the substrate being treated therewith will vary with the substrate and the nature and extent of the effect desired. For most textile applications, however, it has been found that 0.4 to 4.0 weight % of the agent on the fabric, based on the weight of dry fabric, imparts excellent, durable, antistatic soil release characteristics to the fabric. Generally, the preferred amount is $0.8\pm0.1$ weight %.

The process of application of the agent of the invention to the substrate, as described herein, need not be followed in its entirety with respect to the treatment of certain substrates. More particularly, if the substrate is of sufficient polyacidic nature, the polyacidic compound described above need not, of necessity, be present in the treating bath. For example, fabrics made of fibers of acid-modified polymers, such as the commercially available acid-modified polyesters, can be usefully treated with the agent of the invention in the absence of the aforesaid requisite salt and/or polyacidic compound, that is, using only conventional aqueous treating bath ingredients, if sufficient acid-function is provided by the acid-modified polymer.

DESCRIPTION OF THE PREFERRED EMBODIMENTS

The techniques used in the following examples to prepare the agents and to apply them to fabrics for evaluation are substantially the same as those described above. Ideally the antistatic, soil release agent (ASRA) can be represented by:

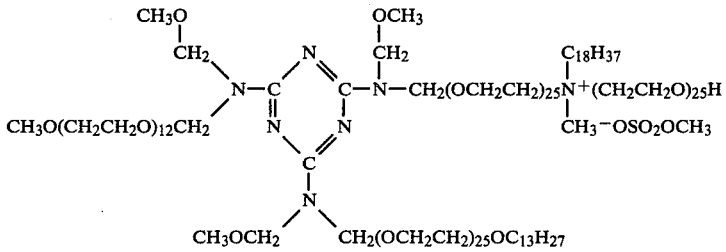

In Examples 1–12, Example 1 is a control for Examples 2–11 using only ASRA and a buffer. Example 12 is a water wash only control for Examples 2–11. PBP stands for Potassium Butyl Phosphates which are made by adjusting the mixed butyl phosphates made by the reactions below wherein R represents $C_4H_9$—, to pH 6.7–7.3 with potassium hydroxide.

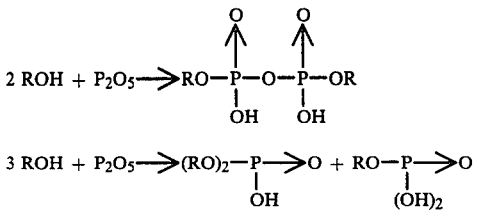

| n-Butyl Alcohol | Phosphoric Anhydride | Mixed Butyl Phosphates |
|---|---|---|

In the Examples LS stands for lauryl sulfate, ASN stands for sodium alkyl sulfonate, wherein the alkyl group is derived from No. 40 white oil, SS stands for 4,4'-thiobis (6-tertiarybutyl-m-cresol), PP stands for polyphosphate, ANSS stands for alkyl naphthalene sodium sulfonate, and OS stands for octodecyl sulfonate. Example 13 is a control for Example 14. Example 15 is a control for Example 16. Example 17 is a control for Example 18. Example 19 is a control for Examples 20 and 21. Example 22 is a control for Example 23. All percentages are "on weight of Fabric" (owf) (Dacron® Polyester Double Knit).

TABLE I

EXHAUST BATH PREPARATIONS

| | Ex. 1 % owf | Ex 2 % owf | Ex 3 % owf | Ex 4 % owf | Ex 5 % owf | Ex 6 % owf |
|---|---|---|---|---|---|---|
| ASRA | 4.0 | 4.0 | 4.0 | 4.0 | 4.0 | 4.0 |
| $Na_2SO_4$ | 14.0 | 14.0 | 14.0 | 14.0 | 14.0 | 14.0 |
| PBP | | | | | 0.50 | 0.75 |
| ASN | | 0.20 | 0.20 | 0.20 | | |
| SS | | | 0.05 | 0.10 | | |

| | Ex 7 % owf | Ex 8 % owf | Ex 9 % owf | Ex 10 % owf | Ex 11 % owf | Ex 12 % owf |
|---|---|---|---|---|---|---|
| ASRA | 4.0 | 3.0 | 3.0 | 3.0 | 3.0 | 0 |
| $Na_2SO_4$ | 14.0 | 14.0 | 14.0 | 14.0 | 14.0 | 0 |
| PBP | 0.75 | 0.75 | 0.75 | 0.75 | 0.75 | 0 |
| ASN | 0.20 | 0.20 | 0.20 | 0.20 | 0.20 | 0 |
| SS | | 0.50 | 0.10 | 0.20 | 0.50 | 0 |

| | Ex 13 % owf | Ex 14 % owf | Ex 15 % owf | Ex 16 % owf | Ex 17 % owf | Ex 18 % owf |
|---|---|---|---|---|---|---|
| ASRA | 4.0 | 4.0 | 4.0 | 4.0 | 4.0 | 4.0 |
| $Na_2SO_4$ | 14.0 | 14.0 | 14.0 | 14.0 | 14.0 | 14.0 |
| ASN | | | | | | 0.20 |
| LS | | 0.15 | | 0.07 | | |

| | Ex 19 % owf | Ex 20 % owf | Ex 21 % owf | Ex 22 % owf | Ex 23 % owf | Ex 24 % owf |
|---|---|---|---|---|---|---|
| ASRA | 4.0 | 4.0 | 4.0 | 4.0 | 4.0 | 4.0 |
| $Na_2SO_4$ | 14.0 | 14.0 | 14.0 | 14.0 | 14.0 | 14.0 |
| ASN | | | | | | |
| LS | | 0.20 | | | 0.20 | |
| ANSS | | | 0.20 | | | |
| PP | | | | | 0.20 | |
| OS | | | | | | 1.7 |

TABLE II

Soil Release Data

| Ex | Initial | 5HWTD | 10HWTD | 15HWTD | 20HWTD | 25HWTD |
|---|---|---|---|---|---|---|
| 1 | 4 | 3–4 | 2+ | 2 | 1–2 | 1–2 |
| 2 | 3–4 | 3–4 | 3+ | 3–4 | 3+ | 3 |
| 3 | 3–4 | 3+ | 3 | 3+ | 3+ | 3 |
| 4 | 3–4 | 3–4 | 3+ | 3+ | 3+ | 3 |
| 5 | 3–4 | 3+ | 2 | 2 | 2 | 2 |
| 6 | 4 | 3–4 | 2+ | 2 | 2 | 1–2 |
| 7 | 4 | 4 | 3–4 | 3–4 | 3+ | 3+ |
| 8 | 3–4 | 4 | 3+ | 3–4 | 3–4 | 3+ |
| 9 | 3–4 | 4 | 3+ | 3+ | 3–4 | 3 |
| 10 | 4 | 4 | 3–4 | 3+ | 3+ | 3 |
| 11 | 3–4 | 4 | 3+ | 3–4 | 3+ | 3 |
| 12 | 1 | 1 | 1 | 1 | 1 | 1 |
| 13 | 3–4 | 3 | 2+ | | | |
| 14 | 3–4 | 4+ | 3+ | | | |
| 15 | 4– | 3 | 2+ | | | |
| 16 | 3–4 | 4 | 3+ | | | |
| 17 | 3–4 | 3 | 2 | | | |
| 18 | 3+ | 3–4 | 3+ | | | |
| 19 | 3–4 | 3 | 3 | | | |
| 20 | 3–4 | 3–4 | 4– | | | |
| 21 | 3+ | 3+ | 4– | | | |
| 22 | 3–4 | 2–3 | 2+ | | | |
| 23 | 3 | 3–4 | 3+ | | | |
| 24 | 3+ | 3–4 | 4 | | | |

TABLE III

ANTISTATIC DATA

| | Keithley Log R at 20% RH | | | | | | |
|---|---|---|---|---|---|---|---|
| Ex | Initial | 5HWTD | 10HWTD | 15HWTD | 20HWTD | 25HWTD | 30HWTD |
| 1 | 12.31 | 13.53 | 14.02 | 14.23 | 14.47 | 15.19 | 14.98 |
| 2 | 11.47 | 12.73 | 13.50 | 13.56 | 14.03 | 14.08 | 14.25 |
| 3 | 11.53 | 13.01 | 13.39 | 13.43 | 13.61 | 13.61 | 13.98 |
| 4 | 11.56 | 13.08 | 13.39 | 13.43 | 13.65 | 13.69 | 14.07 |
| 5 | 12.33 | 13.65 | 14.32 | 14.25 | 14.53 | 14.65 | 14.93 |
| 6 | 12.24 | 13.50 | 14.03 | 14.15 | 14.47 | 14.54 | 14.61 |
| 7 | 11.59 | 12.47 | 13.53 | 13.53 | 13.98 | 14.14 | 14.01 |
| 8 | 11.62 | 12.98 | 13.47 | 13.53 | 13.63 | 14.11 | 14.18 |
| 9 | 11.69 | 13.11 | 13.45 | 13.45 | 13.61 | 13.73 | 14.13 |

TABLE III-continued

| | ANTISTATIC DATA | | | | | | |
|---|---|---|---|---|---|---|---|
| | Keithley Log R at 20% RH | | | | | | |
| Ex | Initial | 5HWTD | 10HWTD | 15HWTD | 20HWTD | 25HWTD | 30HWTD |
| 10 | 11.65 | 13.69 | 13.41 | 13.41 | 13.59 | 13.69 | 14.01 |
| 11 | 11.69 | 13.73 | 13.41 | 13.39 | 13.53 | 13.61 | 13.73 |
| 12 | 15.35 | 14.83 | 15.39 | 15.35 | 15.37 | 15.56 | 15.15 |
| 13 | 12.24 | 13.47 | 14.03 | | | | |
| 14 | 11.35 | 12.94 | 13.41 | | | | |
| 15 | 12.25 | 13.25 | 14.19 | | | | |
| 16 | 12.06 | 13.45 | 14.03 | | | | |
| 17 | 13.11 | 14.69 | 15.23 | | | | |
| 18 | 12.25 | 14.05 | 14.50 | | | | |
| 19 | 12.30 | 13.65 | 14.45 | | | | |
| 20 | 11.59 | 13.28 | 13.98 | | | | |
| 21 | 11.62 | 13.18 | 13.73 | | | | |
| 22 | 12.27 | 13.00 | 14.13 | | | | |
| 23 | 11.92 | 13.18 | 13.65 | | | | |
| 24 | 10.31 | 12.66 | 13.15 | | | | |

TABLE IV

| | Drop Absorption Time seconds | | |
|---|---|---|---|
| Ex | Initial | 5HWTD | 10HWTD |
| 1 | 0 | 30 | 2 |
| 2 | 0 | 1 | 3 |
| 3 | 0 | 41 | 8 |
| 4 | 0 | 60 | 20 |
| 5 | 0 | 10 | 2 |
| 6 | 0 | 20 | 3 |
| 7 | 0 | 1 | 4 |
| 8 | 0 | 20 | 4 |
| 9 | 0 | 9 | 3 |
| 10 | 0 | 60 | 50 |
| 11 | 0 | 53 | 17 |
| 12 | >60 | >60 | >60 |
| 13 | 3 | 29 | 4 |
| 14 | 1 | 1 | 1 |
| 15 | 0 | 1 | 3 |
| 16 | 0 | 0 | 1 |
| 17 | 0 | 1 | 1 |
| 18 | 0 | 1 | 1 |
| 19 | 1 | 36 | — |
| 20 | 0 | 2 | — |
| 21 | 0 | 2 | 1 |
| 22 | 0 | 10 | 1 |
| 23 | 0 | 0 | 0 |
| 24 | — | — | — |

I claim:

1. Process for applying durable, antistatic soil release agent to a substrate, said agent being of the formula

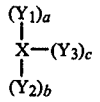

wherein

X is an aminoplast resin moiety having amino nitrogen atoms and 4 to 6 methylene groups, each of which methylene groups is attached to an amino nitrogen atom and to the extent that any such methylene groups are not attached to $Y_1$, $Y_2$, or $Y_3$ they are attached to a $—OCH_3$ group;

$Y_1$ is $O(C_2H_4O)_{5-20}R_1$ wherein $R_1$ is $C_{1-5}$ alkyl;

$Y_2$ is $O(C_2H_4O)_{5-88}R_2$ wherein $R_2$ is $C_{6-20}$ alkyl;

$Y_3$ is

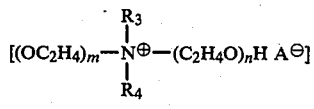

wherein $R_3$ is $C_{4-20}$ alkyl, $C_{4-20}$ alkenyl or benzyl, $R_4$ is $C_{1-4}$ alkyl, $A^{\ominus}$ is an organic or inorganic anion, each of m and n is at least 1 and the sum of m and n is 12 to 100;

each of a and b is 0 to 2 and the sum of a and b is 0 to 2;

c is 1 to 2;

the sum of a, b and c is 1 to 4;

said agent having a calculated hydrophile-lipophile balance (HLB) of 14.5 to 18.0, a 20 weight % aqueous solution viscosity, as measured at 20° C. on a Brookfield viscometer, of 0.250 to 16.000 pascal seconds, an electrical resistivity (Keithley Log R) on polyester fabric, at 20±2% relative humidity and 23°±1° C. of no greater than 13.00 initially and no greater than 14.25 after ten washes, and a soil release rating on polyester fabric of at least 3 initially, said process comprising the steps:

(a) diluting the agent with water to achieve the desired concentration and viscosity, (b) adding sufficient salt of a mono-, di- or trivalent metal or of an ammonium cation to achieve a cloud point (measured as described herein), of the diluted agent of step (a), of less than 100° C. but greater than 25° C., or adding sufficient polyacidic compound having a second dissociation constant of greater than $1\times10^{-8}$ to achieve a pH of the diluted agent of step (a) of 3.0 to 6.0, or adding both said salt and said polyacidic compound to achieve said cloud point and pH, (c) adding from about 0.07 to 0.8% wt % on weight of fabric of an anionic surfactant selected from the class consisting of alkyl sulfates containing from 12 to 22 carbon atoms, alkyl sulfonates containing from 12 to 24 carbon atoms and alkaryl sulfonates containing 3 to 16 alkyl carbon atoms and phenylene or naphthylene as the aromatic moiety, (d) further diluting the agent to the desired application concentration, (e) applying the diluted agent of step (c) to the substrate to be treated so as to achieve the desired level of agent on the substrate, (f) drying and curing the agent on the substrate, and (g) recovering substrate which has been durably treated with the agent of the aforesaid formula.

2. Process of claim 1 wherein step (b) is carried out by adding only salt and step (e) is an exhaust application step.

3. Process of claim 2 wherein the substrate is a textile fabric.

4. Process of claim 2 wherein the substrate is a polyester textile fabric.

5. Process of claim 3 wherein the salt is the nitrate, phosphate, chloride, sulfate, oxalate, acetate or citrate of a sodium magnesium, calcium, zinc, aluminum or ammonium cation.

6. The process of claim 5 wherein the anionic surfactant in step (c) is an alkyl sulfate wherein the alkyl group contains from 12 to 22 carbon atoms.

7. The process of claim 5 wherein the anionic surfactant in step (c) is an alkaryl sulfonate containing from 3 to 16 alkyl carbon atoms and phenylene or naphthylene as the aromatic moiety.

8. The process of claim 5 wherein the anionic surfactant in step (c) is an alkyl sulfonate wherein the alkyl group contains from 12 to 24 carbon atoms.

9. The process of claim 8 wherein from 0.3 to 1:0 wt % an alkali metal salt of one or more alkyl phosphates is added.

10. The process of claim 9 wherein the alkali metal salt of one or more alkyl phosphates is potassium mixed butyl phosphates.

11. The process of claim 1 wherein step (b) is carried out by adding only polyacidic compound and step (e) is a pad application step.

12. The process of claim 11 wherein the substrate is a textile fabric.

13. The process of claim 12 wherein the substrate is a polyester textile fabric.

14. The process of claim 12 wherein the salt is the nitrate, phosphate, chloride, sulfate, oxalate, acetate or citrate of a sodium, magnesium, calcium, zinc, aluminum, or ammonium cation.

15. The process of claim 14 wherein the anionic surfactant in step (c) is an alkyl sulfate wherein the alkyl group contains from 12 to 22 carbon atoms.

16. The process of claim 14 wherein the anionic surfactant in step (c) is an alkaryl sulfonate containing from 3 to 22 carbon atoms and phenylene or naphthylene as the aromatic moiety.

17. The process of claim 14 wherein the anionic surfactant in (c) is an alkyl sulfonate wherein the alkyl group contains from 12 to 24 carbon atoms.

18. The process of claim 17 wherein from 0.3 to 1.0 wt % on weight of fabric of an alkali metal salt of one or more alkyl phosphates is added.

19. The process of claim 18 wherein the alkali metal salt of one or more alkyl phosphates is potassium mixed butyl phosphates.

* * * * *